US007641298B2

(12) United States Patent
Hirath et al.

(10) Patent No.: US 7,641,298 B2
(45) Date of Patent: Jan. 5, 2010

(54) HEAT-INSULATED WALL

(75) Inventors: Jürgen Hirath, Leesburg, VA (US); Markus Schütte, Nürnberg (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 12/006,515

(22) Filed: Jan. 2, 2008

(65) Prior Publication Data

US 2008/0110128 A1 May 15, 2008

Related U.S. Application Data

(62) Division of application No. 09/174,042, filed on Oct. 16, 1998, now abandoned.

(30) Foreign Application Priority Data

Oct. 16, 1997 (DE) ..... 197 45 860

(51) Int. Cl.
*F16L 59/06* (2006.01)
*A47B 96/04* (2006.01)

(52) U.S. Cl. ..... 312/401; 428/69

(58) Field of Classification Search ..... 428/69; 312/400, 401, 406.1, 406, 409; 29/458, 460, 29/525.01, 525.14; 52/788.1; 62/45.1, DIG. 13, 62/907, 440, 465; 220/592.27, 560.1
See application file for complete search history.

(56) References Cited

U.S. PATENT DOCUMENTS 1,933,772 A * 11/1933 Stresau ..... 285/201
2,345,792 A * 4/1944 Cann ..... 312/290
2,608,191 A * 8/1952 Schmidt et al. ..... 126/25 R
3,006,158 A * 10/1961 Horvay ..... 62/273
3,353,621 A * 11/1967 Clevett, Jr. ..... 180/124
3,440,308 A * 4/1969 Carbary et al. ..... 264/45.3
3,619,482 A * 11/1971 Boor ..... 174/152 G
3,771,816 A * 11/1973 Hord, Jr. ..... 280/433
3,834,577 A * 9/1974 Tempero ..... 312/401
4,180,297 A * 12/1979 Abrams ..... 312/406
4,186,945 A * 2/1980 Hahn ..... 285/19
4,299,429 A * 11/1981 Franklin, Jr. ..... 312/236
4,444,821 A * 4/1984 Young et al. ..... 428/69
4,715,512 A * 12/1987 Buchser ..... 220/592.1

(Continued)

FOREIGN PATENT DOCUMENTS

DE 1004207 * 3/1957

*Primary Examiner*—Janet M Wilkens
(74) *Attorney, Agent, or Firm*—James E. Howard; Andre Pallaples

(57) ABSTRACT

A heat-insulated wall has two outer covering layers which are disposed at a distance from one another and are constructed at least substantially vacuum-tight. The two outer covering layers are connected to one another in a vacuum-tight manner by a connecting profile that runs along their contour and has a U-shaped cross section. The two outer covering layers together with the connecting profile enclose an intermediate space that can be evacuated and filled with an evacuable heat insulating material. At least one tubular bushing for cables or the like runs through the intermediate space. The bushing connects apertures to one another that are formed the spaced-apart outer covering layers. The tubular bushing is provided on its two end sections with a flange-shaped expanded and flattened region by which the bushing is fixed in a vacuum-tight manner on the mutually facing inner sides of the two outer covering layers.

28 Claims, 2 Drawing Sheets

U.S. PATENT DOCUMENTS 4,805,293 A * 2/1989 Buchser ..... 29/460
6,158,833 A * 12/2000 Engler ..... 312/409
6,291,792 B1 * 9/2001 Fussnegger et al. ..... 219/118

* cited by examiner

HEAT-INSULATED WALL

CROSS-REFERENCE TO RELATED APPLICATIONS

This application is a Divisional, under 35 U.S.C. § 121, of U.S. application Ser. No. 09/174,042, filed Oct. 16, 1998 now abandoned. This application also claims the priority, under 35 U.S.C. § 119, of German patent application No. 197 45 860.2, filed Oct. 16, 1997; the prior applications are herewith incorporated by reference in their entirety.

BACKGROUND OF THE INVENTION

Field of the Invention

The invention relates to a heat-insulated wall having two outer covering layers that are disposed at a distance from one another and are at least substantially vacuum-tight. The outer covering layers are connected in a vacuum-tight manner by a connecting profile that runs along their contour. The covering layers together with the connecting profile, enclose an intermediate space which can be evacuated and is filled with an evacuable heat insulating material. At least one of the covering layers has an aperture that is connected in a vacuum-tight manner to a tube section.

It is known for heat-insulated walls and housings based on vacuum technology to be used in domestic appliances, for example refrigerators, freezers and domestic ovens. The walls and housings which are known to date for these applications are equipped with tubular bushings (pipes) which are used, for example, for electrical connecting and signal cables or for a condensed water run-off line from the inside of the appliance, to pass through the heat-insulating wall to the exterior. The bushings which are used for this purpose have until now been formed by a tube which is inserted into in each case one hole in the outer housing shell and is fixed there on the outside in a vacuum-tight manner by welding.

Such a construction results in the components to be connected to one another, by being inserted into one another, to have a relatively high fit accuracy in order to be able to guarantee vacuum-tight welding of the connection partners by conventional welding processes, for example microplasma welding, even in mass production. The requirement to which the components to be connected are subject in this context, in terms of shape and dimensional tolerances, slow down and exacerbate the manufacturing process of the housings and walls, as a result of which their production costs rise considerably. Furthermore, in the case of the known solution for a bushing, it is inevitable that the two outer housing shells have to be positioned with their apertures essentially superimposed one above the other in order to avoid stresses in the welded seam connection resulting from an offset between the apertures. Under some circumstances, such stresses can lead to leaks at the welded connection within the normal working life of a housing. Furthermore, with regard to the conventional bushing configuration, care must be taken to use connecting tubes whose walls are as thin as possible in order to keep as low as possible the heat bridge produced in this way, caused by the thermal conduction in the connecting tube. This, however, considerably exacerbates not only the process of welding the connecting tube to the housing outer shells, but also the handling of the tube during the manufacture of the housing.

SUMMARY OF THE INVENTION

It is accordingly an object of the invention to provide a heat insulated wall that overcomes the above-mentioned disadvantages of the prior art devices of this general type, which is simple to construct.

With the foregoing and other objects in view there is provided, in accordance with the invention, a heat insulated wall, including: a connecting profile; an evacuable heat insulating material; two outer covering layers having contours and disposed at a distance from one another, the two outer covering layers connected to one another in a vacuum-tight manner by the connecting profile running along the contours, the two outer covering layers together with the connecting profile enclose an intermediate space that can be evacuated and filled with the evacuable heat insulating material, at least one of the two outer covering layers having an aperture formed therein; and a tube section including two end sections, and one of the two end sections having a circumferentially positioned flange-shaped expanded and flattened region fixed in a vacuum-tight manner in the aperture of the at least one of the two outer covering layers.

The object is achieved according to the invention in that the tube section is provided circumferentially on one of its two end sections with a flange-like expanded and flattened region by which the tube section is fixed in a vacuum-tight manner on one of the covering layers.

As a result of the bushing being configured as a tube section having flange surfaces fitted on at least one of its two ends, the bushing can be fixed with a high degree of process reliability on both covering layers and in large-scale production, such that it is stable in the long term and is vacuum-tight, even if the apertures in the covering layers (which are used as housing shells) and the tube opening are not exactly aligned with one another as a result of some sort of manufacturing or joining tolerances and there is therefore a certain amount of offset between the apertures in the housing shells and the tube openings associated with them. The flange on one of the two ends of the tube section allows it to be attached by welding to the covering layer in a reliable process, even if the center of the aperture is disposed offset with respect to the center of the tube section.

According to an advantageous development of the invention, in the case of the tube section that is disposed between the covering layers equipped with apertures and connects the apertures to one another, the tube section is used for passing electrical cables and the like. The tube section is provided at its two free ends with a flange-like expanded and flattened region by which the tube section is fixed in a vacuum-tight manner on the mutually facing inner sides of the covering layers.

Such a configuration of the tube section allows the tube section which forms the actual bushing to be constructed with a thin wall thickness in order to reduce the heat losses caused by thermal conduction in the bushing. Because the bushing is attached by the flange-like expanded and flattened regions which, by virtue of their broad-area contact and robust configuration, facilitate a reliable, vacuum-tight connection to the covering layers of the heat-insulated wall, ensures a reliable process management with a high process rate together with low manufacturing costs for large-scale production in the consumer goods industry. Furthermore, the capability to compensate for position tolerances relating to the apertures in the covering layers is further improved.

The bushing can be produced particularly easily and cost-effectively if, according to one preferred embodiment of the invention, the tube section and the flange-like expanded and flattened regions have a circular cross section. The circular cross section of the tube section makes it possible for the expanded and flattened regions provided on the end section of the tube section to be formed cost-effectively, for example as stampings, which are then connected in a vacuum-tight manner to the tube section.

According to a next preferred embodiment of the invention, the tube section is integrated with the expanded and flattened region(s) disposed on it.

Where the tube section and the flange-like expanded and flattened regions have a circular cross section, the bushing can be constructed, for example, as a turned part which can be produced cost-effectively and precisely, and whose precise dimensions and shape make it considerably easier to introduce the items between the covering layers and the heat-insulated wall.

According to another preferred embodiment of the invention, the tube section has a cross section that corresponds at least substantially to the unobstructed width of the aperture.

Matching the cross section of the tube section to the unobstructed width of the aperture makes it possible to use a simple centering means to achieve particularly accurate alignment of the aperture with respect to the tube section. Furthermore, a bushing cross section is provided at the same time for electrical cables or pipes carrying coolant to pass through which allows the cables and pipes to pass through the heat-insulated wall freely and without impedance.

A permanently vacuum-tight connection between the covering layers of the heat-insulated wall and the flange-like expanded and flattened regions of the tube section can be produced in a particularly simple manner when the covering layers and the tube section together with the flange-like expanded and flattened region(s) disposed on it are composed of stainless steel or steel and are connected to one another by a beam-welding process. The electron beam welding process or a laser beam welding process are particularly suitable for use as the beam welding processes.

According to a further preferred embodiment of the invention, the welded connection between the covering layers and the flange-like expanded and flattened region is provided in the region closest to the free edges of the flange-like expanded and flattened region.

Such a configuration of the weld seam ensures a vacuum-tight connection of the covering layers to the flange-like expanded and flattened regions even if the apertures in the covering layers are disposed with a considerable offset with respect to one another, caused by manufacturing shortcomings. In this manner the flange-like expanded and flattened region and the aperture associated with it can be disposed with their centers considerably offset with respect to one another. Furthermore, the air enclosures are minimized, particularly if the tube section is used as a bushing.

The flange-like expanded and flattened regions can be welded to the covering layers (which are formed from stainless steel or corrosion-protected steel) of the heat-insulated walls in a particularly permanent and vacuum-tight manner if, according to a next preferred embodiment of the subject matter of the invention, the flange-like expanded and flattened region(s)>has a material thickness which corresponds at least to the material thickness of the covering layers. The greater the material thickness of the flange-like expanded and flattened region is chosen to be, the more dimensionally stable it is with respect to handling during the manufacturing process.

The heat-insulated housing of a refrigerator is constructed in a manner which is particularly convenient for manufacture, with reliable processes and can be recycled in an environmentally friendly manner if, according to a next preferred embodiment of the invention, the heat-insulated housing is constructed according to the above described invention.

An oven muffle of a domestic oven is likewise configured in a manner that is particularly convenient for manufacture, with reliable processes and can be recycled economically if, according to a next preferred embodiment of the invention, the oven muffle is constructed according to the above described invention.

Other features which are considered as characteristic for the invention are set forth in the appended claims.

Although the invention is illustrated and described herein as embodied in a heat insulated wall, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
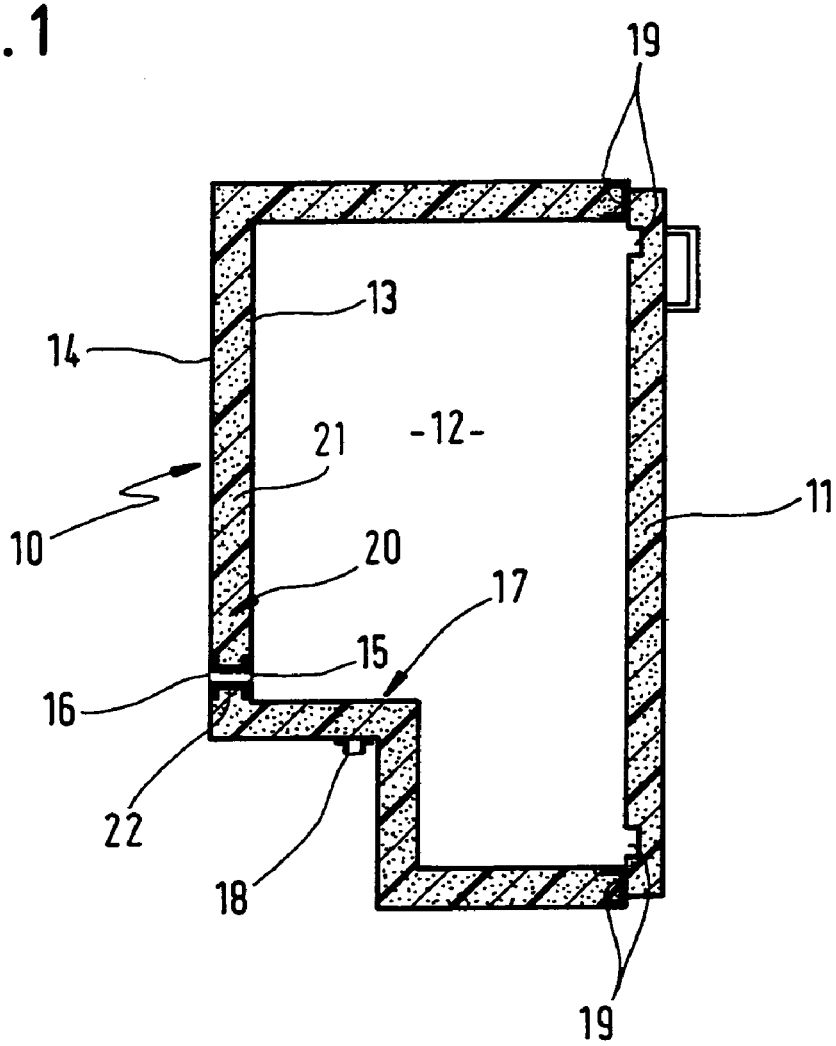
FIG. 1 is a sectional view of a heat insulated housing of a domestic refrigerator having a bushing, which is disposed on its housing rear wall, for pipes and cables and has an evacuation connecting stub provided in a region of its machine area.

In all the figures of the drawing, sub-features and integral parts that correspond to one another bear the same reference symbol in each case. Referring now to the figures of the drawing in detail and first, particularly, to FIG. 1 thereof, there is shown a heat insulated housing 10 that is suitable for use for a domestic refrigerator or freezer and within which a useable compartment area 12 is provided which is accessible via a door 11. The compartment area 12 is clad by a covering layer 13 that is an inner cladding and at a distance from which a covering layer 14 is disposed that is an outer cladding. The covering layer 14 like the covering layer 13, is formed, for example, from stainless-steel sheeting or corrosion-protected steel sheeting with a material thickness of 0.4 mm. The covering layers 13 and 14 are each provided on their rear side opposite the door 11 with a circular-cylindrical cross section aperture 15 and 16, respectively, with the same diameter. The apertures, according to a first configuration type, are disposed opposite one another, with at least approximately the same axes. A further aperture 18, which is configured with a circular cross section and is incorporated in the covering layer 14, is provided on the horizontal section of a step 17, which opens up to a machine area, at a distance from the aperture 16.

The outer covering layer 14 and the inner covering layer 13 which is at a distance from it enclose, together with a connecting profile 19 (which is fixed by welding in a vacuum-tight manner at its free edges facing the door 11 and is composed of stainless-steel sheeting or corrosion-protected steel sheeting), an intermediate space 20 which can be evacuated. In order to support the covering layers 13 and 14, the intermediate space 20 is filled with a heat insulating material 21 that is in the form of a panel. The heat insulating material 21 can be evacuated and is composed of open-cell polyurethane foam or open-cell polystyrene foam. Passing through the heat insulating material 21 is a tube-shaped bushing 22, which connects the two apertures 15 and 16 to one another. The tube-shaped bushing is embedded in the heat insulating material 21 and is used, for example, for electrical cables or pipes carrying coolant to pass out of the compartment area 12.

Figure 2:
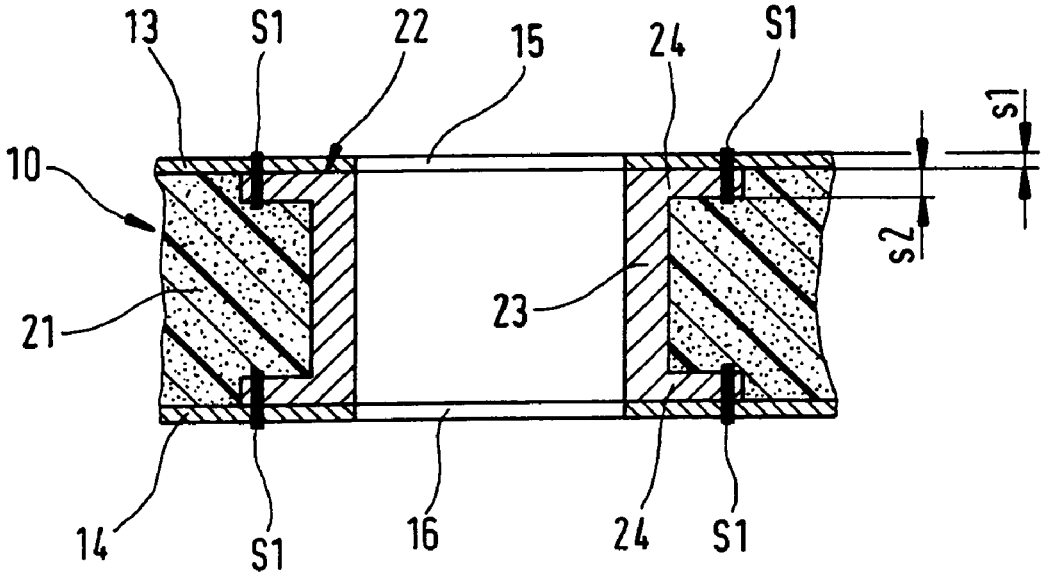
FIG. 2 is a fragmentary, sectional view of a detail of the heat insulated housing in a region of the bushing, in an illustration rotated through 90° with respect to FIG. 1.
Figure 4:
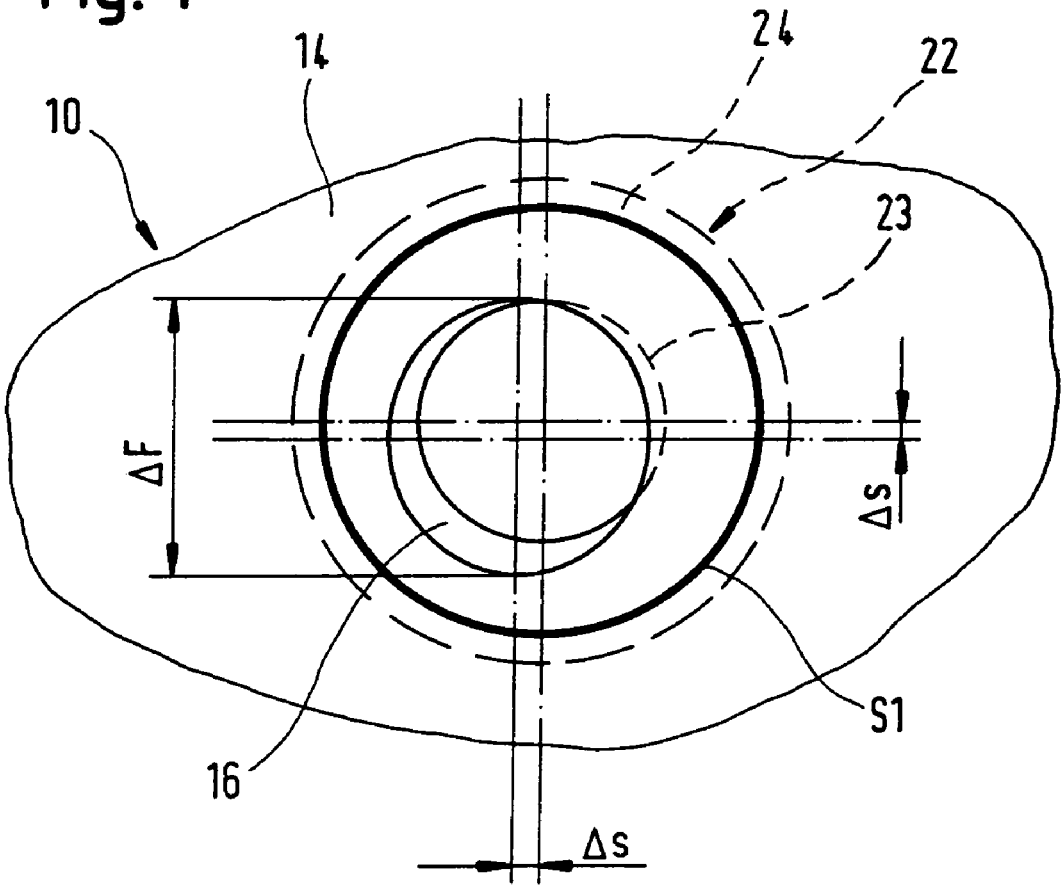
FIG. 4 is a side elevational view of the bushing disposed offset with respect to an aperture in one of the outer covering layers of the heat-insulated housing.

As can be seen in particular from FIG. 2, the bushing 22 has a tube section 23 which is configured as a hollow circular cylinder, whose opening cross section is essentially matched to the cross section of the apertures 15 and 16. A tube axis of the tube section 23 runs through the center of the two apertures 15 and 16. At its two ends, the tube section 23 has flange-shaped expanded and flattened regions 24 that are integrally formed on its tube body. The flange-shaped expanded and flattened regions 24 are disposed circumferentially along the outer contour of the tube section 23, and their outer sides rest against the inner sides (which face the intermediate space 20) of the covering layers 13 and 14. The flange-like expanded and flattened regions 24 are configured with an annular cross section and are used for vacuum-tight connecting the bushing 22 to the covering layers 13 and 14 using a beam-welding process. A circular weld seam S1 which is produced in this case and is constructed to be closed is disposed in the region close to the free edges of the expanded and flattened regions 24 and passes through the respective connection pieces to be connected. The expanded and flattened regions 24 on the bushing 22, in combination with the weld seam S1 disposed in the edge region of the expanded and flattened regions 24, provide a vacuum-tight connection of the bushing 22 to the covering layers 13 and 14. The vacuum-tight connection is maintained even in the situation where the circular circumferential cross section of the tube section 23 has a center offset $\Delta s$ from the center of one of the apertures 15 or 16 or one of the apertures 15, 16 are deformed in the shape of an oval, or even if the opening cross section of the tube section is of a deformed shape $\Delta f$ (see FIG. 4). The expanded and flattened regions 24 and the configuration of the weld seam S1 make it possible to compensate for a center offset between the center of the opening cross section of the tube section 23 and the center of the aperture 16 in the order of magnitude of about 20% of the diameter of the tube opening cross section of the apertures 15 or 16.

Figure 3:
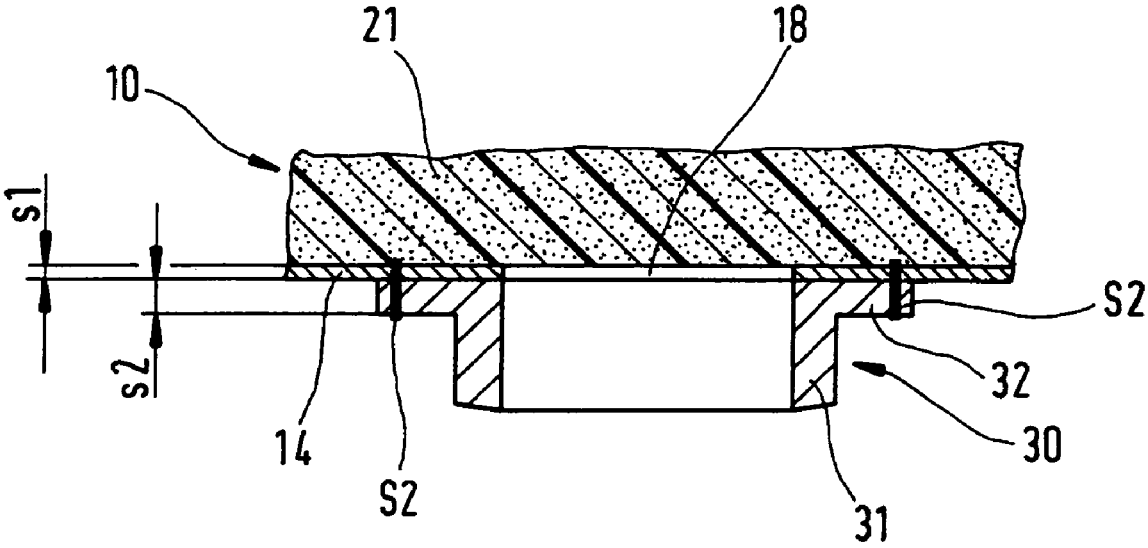
FIG. 3 is an enlarged, fragmentary, sectional view of the heat insulated housing in a region of the evacuation connecting stub.

The compensation capability is also provided for an evacuation connecting stub 30 which is shown in FIG. 3. The evacuation connecting stub 30 is manufactured from stainless steel or corrosion-protected steel and is fixed in a vacuum-tight manner on the outer side of the outer covering layer 14. The evacuation connecting stub 30 is formed from a hollow cylindrical tube section 31 and a flange-shaped expanded and flattened region 32 which is integrally formed on one of its end sections and circumferentially surrounds the tube section 31, with the same contours. The cylindrical tube section 31 is aligned with its tube axis to the center of the aperture 18. The aperture 18 is configured with a circular cross section and whose opening cross section is essentially matched to the opening cross section of the tube section 31, so that the aperture 18 and the opening cross section of the tube section 31 of the evacuation connecting stub 30 are aligned. The evacuation connecting stub 30 is fixed in a vacuum-tight manner, with the aid of its expanded and flattened region 32, on the outside of the outer covering layer 14 by beam welding. A weld seam S2 produced by the welding process is disposed in an annular shape circumferentially in the region close to the free edge of the expanded and flattened region 32 and passing through both the expanded and flattened region 32 and the covering layer 14. In order that the welding process can be carried out in a reliable process during large-scale production of the housing 10, both the expanded and flattened region 32 and the expanded and flattened region 24 have a material thickness S2 which is at least twice the material thickness S1 of the covering layer 13 or of the covering layer 14.

The vacuum-tight fixing of the bushing 22 or of the evacuation connecting stub 30 with the expanded and flattened regions 24 and 32 provided respectively for this purpose is not suitable just for use in the heat insulated housing for a refrigerator, but can just as well be used for a heat insulated housing for an oven muffle of a household oven. In an oven muffle, the covering layers can be manufactured, in the same way as the housing 10, from stainless-steel sheeting or corrosion-protected steel sheeting, although the heat insulating material which is used to support the covering layers after the evacuation process would have to be constructed for temperatures which occur in ovens.

The welded connection between the covering layers and the flange-like expanded and flattened region may also be configured as a fillet weld along the free edge of the expanded and flattened region.

We claim:

1. A heat insulated wall product made by a process comprising:

providing a connecting profile, an evacuable heat insulating material, two outer covering layers each having a pass-through aperture, and a tube section including a hollow bore and two end sections with at least one of the two end sections having a circumferentially positioned flange-shaped expanded and flattened region;

connecting the two outer covering layers to the connecting profile with a vacuum-tight seal and with a disposition of the two outer covering layers at a spacing from one another with their pass-through apertures generally aligned with one another, the two outer covering layers together with the connecting profile delimiting an intermediate space;

disposing the tube section relative to the two outer covering layers with the pass-through aperture of each outer covering layer being in communication with the hollow bore of the tube section and with the at least one flange-shaped expanded and flattened region in facing relation to an interior surface of a selected one of the two outer covering layers that faces toward the other outer covering layer;

connecting in a sealed manner the selected one outer covering layer to the flange-shaped expanded and flattened region of the tube section;

disposing the evacuable heat insulating material in the intermediate space delimited by the two outer covering layers and the connecting profile; and disposing the intermediate space delimited by the two outer covering layers and the connecting profile in an evacuated condition.

2. The heat insulated wall product made by the process according to claim 1, wherein each of the two end sections of the tube section having one of the flange-shaped expanded and flattened regions and further comprising securing the tube section on mutually facing inner sides of the two outer covering layers with a vacuum-tight seal.

3. The heat insulated wall product made by the process according to claim 2, wherein the step of securing the tube section on mutually facing inner sides of the two outer covering layers with a vacuum-tight seal includes connecting the two outer covering layers to the flange-shaped expanded and flattened region by a continuous welded connection.

4. The heat insulated wall product made by the process according to claim 1, wherein the step of providing includes making the two outer covering layers and the tube section from a corrosion-protected steel material.

5. The heat insulated wall product made by the process according to claim 4, wherein the connecting profile comprises stainless-steel sheeting or corrosion protected steel sheeting.

6. The heat insulated wall product made by the process according to claim 1, wherein the step of providing includes providing one of said two outer covering layers with a third aperture, and the step of disposing the intermediate space delimited by the two outer covering layers and the connecting profile in the evacuated condition includes evacuating the interior volume via the third aperture.

7. The heat insulated wall product made by the process according to claim 1, wherein the selected one outer covering layer includes an exterior surface spaced from and facing away from its interior surface and the step of connecting in a sealed manner the selected one outer covering layer to the flange-shaped expanded and flattened region of the tube section includes applying a weld through the exterior surface of the selected one outer covering layer that engages and secures the flange-shaped expanded and flattened region of the tube section to the selected one outer covering layer.

8. The heat insulated wall product made by the process according to claim 7, wherein the step of applying a weld through the exterior surface of the selected one outer covering layer that engages and secures the flange-shaped expanded and flattened region of the tube section to the selected one outer covering layer includes applying a circular weld seam that passes through the exterior surface of the selected one outer covering layer to the flange-shaped expanded and flattened region of the tube section.

9. The heat insulated wall product made by the process according to claim 1, wherein the step of providing includes providing each of the two outer covering layers with a material thickness and a tube section with a flange-shaped expanded and flattened region that has a material thickness being at least substantially twice the material thickness of the two outer covering layers.

10. The heat insulated wall product made by the process according to claim 1 and further comprising forming the at least one flange-shaped expanded and flattened region of the tube section to compensate for positional imprecision between the pass-through apertures of the two outer covering layers and the tube section to thereby permit the tube center to be offset from the centers of the pass-through apertures of the two outer covering layers while maintaining the vacuum-tight seal between flange-shaped expanded and flattened region of the tube section and the selected one outer covering layer.

11. The heat insulated wall product made by the process according to claim 10, wherein the step of forming the at least one flange-shaped expanded and flattened region to compensate for positional imprecision between the aperture and the tube section permits the tube center to be offset from the centers of the pass-through apertures of the two outer covering layers a distance up to about 20 percent of the aperture diameter while maintaining the vacuum-tight seal between flange-shaped expanded and flattened region of the tube section and the selected one outer covering layer.

12. The heat insulated wall product made by the process according to claim 1, wherein the connecting profile comprises stainless-steel sheeting or corrosion protected steel sheeting.

13. The heat insulated wall product made by the process according to claim 1, wherein the connecting profile has a generally U-shaped cross section.

14. The heat insulated wall product made by the process according to claim 1, wherein the at least one flange-shaped expanded and flattened region is welded with a weld to the interior surface of the selected one of the outer covering layers, and a material thickness of the selected one of the covering layers in relation to a material thickness of the flange-shaped expanded and flattened region is dimensioned to reliably form the weld.

15. A method for making a heat insulated wall product, the method comprising:

providing a connecting profile, an evacuable heat insulating material, two outer covering layers each having a pass-through aperture, and a tube section including a hollow bore and two end sections with at least one of the two end sections having a circumferentially positioned flange-shaped expanded and flattened region;

connecting the two outer covering layers to the connecting profile with a vacuum-tight seal and with a disposition of the two outer covering layers at a spacing from one another with their pass-through apertures generally aligned with one another, the two outer covering layers together with the connecting profile delimiting an intermediate space;

disposing the tube section relative to the two outer covering layers with the pass-through aperture of each outer covering layer being in communication with the hollow bore of the tube section and with the at least one flange-shaped expanded and flattened region in facing relation to an interior surface of a selected one of the two outer covering layers that faces toward the other outer covering layer;

connecting in a sealed manner the selected one outer covering layer to the flange-shaped expanded and flattened region of the tube section;

disposing the evacuable heat insulating material in the intermediate space delimited by the two outer covering layers and the connecting profile; and disposing the intermediate space delimited by the two outer covering layers and the connecting profile in an evacuated condition.

16. The method according to claim 15, wherein each of the two end sections of the tube section has one of the flange-shaped expanded and flattened regions and the method further comprises securing the tube section on mutually facing inner sides of the two outer covering layers with a vacuum-tight seal.

17. The method according to claim 16, wherein the step of securing the tube section on mutually facing inner sides of the two outer covering layers with a vacuum-tight seal includes connecting the two outer covering layers to the flange-shaped expanded and flattened region by a continuous welded connection.

18. The method according to claim 15, wherein the step of providing includes making the two outer covering layers and the tube section from a corrosion-protected steel material.

19. The method according to claim 18, wherein the connecting profile comprises stainless-steel sheeting or corrosion protected steel sheeting.

20. The method according to claim 15, wherein the step of providing includes providing one of said two outer covering layers with a third aperture, and the step of disposing the intermediate space delimited by the two outer covering layers and the connecting profile in the evacuated condition includes evacuating the interior volume via the third aperture.

21. The method according to claim 15, wherein the selected one outer covering layer includes an exterior surface spaced from and facing away from its interior surface and the step of connecting in a sealed manner the selected one outer covering layer to the flange-shaped expanded and flattened region of the tube section includes applying a weld through the exterior surface of the selected one outer covering layer that engages and secures the flange-shaped expanded and flattened region of the tube section to the selected one outer covering layer.

22. The method according to claim 21, wherein the step of applying a weld through the exterior surface of the selected one outer covering layer that engages and secures the flange-shaped expanded and flattened region of the tube section to the selected one outer covering layer includes applying a circular weld seam that passes through the exterior surface of the selected one outer covering layer to the flange-shaped expanded and flattened region of the tube section.

23. The method according to claim 15, wherein the step of providing includes providing each of the two outer covering layers with a material thickness and a tube section with a flange-shaped expanded and flattened region that has a material thickness being at least substantially twice the material thickness of the two outer covering layers.

24. The method according to claim 15, further comprising forming the at least one flange-shaped expanded and flattened region of the tube section to compensate for positional imprecision between the pass-through apertures of the two outer covering layers and the tube section to thereby permit the tube center to be offset from the centers of the pass-through apertures of the two outer covering layers while maintaining the vacuum-tight seal between flange-shaped expanded and flattened region of the tube section and the selected one outer covering layer.

25. The method according to claim 24, wherein the step of forming the at least one flange-shaped expanded and flattened region to compensate for positional imprecision between the aperture and the tube section permits the tube center to be offset from the centers of the pass-through apertures of the two outer covering layers a distance up to about 20 percent of the aperture diameter while maintaining the vacuum-tight seal between flange-shaped expanded and flattened region of the tube section and the selected one outer covering layer.

26. The method according to claim 15, wherein the connecting profile comprises stainless-steel sheeting or corrosion protected steel sheeting.

27. The method according to claim 15, wherein the connecting profile has a generally U-shaped cross section.

28. The method according to claim 15, wherein the at least one flange-shaped expanded and flattened region is welded with a weld to the interior surface of the selected one of the outer covering layers, and a material thickness of the selected one of the covering layers in relation to a material thickness of the flange-shaped expanded and flattened region is dimensioned to reliably form the weld.

* * * * *